US009504869B2

(12) United States Patent
Gavigan

(10) Patent No.: US 9,504,869 B2
(45) Date of Patent: Nov. 29, 2016

(54) SYN RINGS FOR DYNAMIC WEIGHT SUSPENSION

(71) Applicant: Andrew Gavigan, West Hills, CA (US)

(72) Inventor: Andrew Gavigan, West Hills, CA (US)

( * ) Notice: Subject to any disclaimer, the term of this patent is extended or adjusted under 35 U.S.C. 154(b) by 0 days.

(21) Appl. No.: 14/153,209

(22) Filed: Jan. 13, 2014

(65) Prior Publication Data

US 2015/0196793 A1 Jul. 16, 2015

(51) Int. Cl.
*A63B 21/072* (2006.01)
*A63B 21/078* (2006.01)

(52) U.S. Cl.
CPC ..... *A63B 21/0728* (2013.01); *A63B 21/0724* (2013.01)

(58) Field of Classification Search
CPC ..... A63B 2021/00; A63B 2021/002; A63B 2021/0026; A63B 2021/06; A63B 2021/0611; A63B 2021/0614; A63B 2021/0615; A63B 2021/0616; A63B 2021/0617; A63B 2021/062; A63B 2021/0623; A63B 2021/02626; A63B 2021/072; A63B 2021/078; A63B 2021/0783; A63B 2021/0786; A63B 2021/22; A63B 2021/222; A63B 2022/00; A63B 2022/0002; A63B 23/00; A63B 23/035; A63B 23/03508; A63B 23/03516; A63B 23/0355; A63B 23/12; A63B 23/231209; A63B 23/1218; A63B 23/1227; A63B 21/00087; A63B 21/00094; A63B 21/072; A63B 21/0724; A63B 21/0726; A63B 21/0728; A63B 21/075; A63B 21/078; A63B 21/08; A63B 11/00; A63B 13/00; A63B 15/00
USPC ..... 482/92–93, 98–108
See application file for complete search history.

(56) References Cited

U.S. PATENT DOCUMENTS 3,904,198 A * 9/1975 Jones ..... A63B 21/0724 482/106
4,216,959 A * 8/1980 Niles ..... A63B 21/078 24/299
4,368,883 A * 1/1983 Tiktin ..... A63B 21/065 2/162
4,709,922 A * 12/1987 Slade, Jr. ..... A63B 21/0783 482/104
4,890,831 A * 1/1990 Craig ..... A63B 21/0724 482/104

(Continued)

OTHER PUBLICATIONS

Proloc Collars 2, Aug. 18, 2013, YouTube Video: https://youtu.be/wFhW2Baviz0 "Henry Thomason—Pro Powerlifter—Talks about Proloc Collars 2 (chains) www.proloccollars.com" by hthomason.*

(Continued)

*Primary Examiner* — Loan H Thanh
*Assistant Examiner* — Andrew S Lo
(74) *Attorney, Agent, or Firm* — William J. Benman; Benman, Brown & Williams

(57) ABSTRACT

A suspension apparatus including first and second rings, each ring having an inner periphery with an inner radius greater than the outer radius of a standard barbell bar; a coupler secured to the outer periphery of each ring; a strap; and first and second fasteners secured to opposite ends of the strap. The strap is inserted through an opening in a barbell weight and secured to the rings. In the best mode, the rings are metallic, the strap is nylon and the coupler is attached to an elastic ring secured to the outer periphery of a respective one of the rings, whereby the weight is free to swing about a point between the rings on the bar over an angle as well as up and down.

8 Claims, 5 Drawing Sheets

(56) References Cited

U.S. PATENT DOCUMENTS 4,911,434 A * 3/1990 Herring ..... A63B 21/065 482/105
4,974,836 A * 12/1990 Hirsch ..... A63B 21/06 473/451
4,984,786 A * 1/1991 Lemke ..... A63B 21/4001 482/105
5,029,849 A * 7/1991 Nurkowski ..... A63B 21/072 482/106
5,048,826 A * 9/1991 Ryan ..... A63B 21/00181 482/104
D345,999 S * 4/1994 Adkins ..... D21/675
5,468,203 A * 11/1995 Okonkwo ..... A63B 21/078 248/125.2
5,588,940 A * 12/1996 Price ..... A63B 21/4005 224/259
5,891,004 A * 4/1999 Berry ..... A63B 21/04 482/106
6,436,016 B1 * 8/2002 Valentino ..... A63B 21/075 482/104
7,789,814 B1 * 9/2010 Xu ..... A63B 21/0728 482/107
7,841,970 B2 * 11/2010 Striar ..... A63B 21/06 482/93
8,506,460 B2 * 8/2013 Seitzer ..... A63B 21/4015 482/106
2004/0018921 A1 * 1/2004 Smith ..... A63B 21/065 482/105
2004/0082442 A1 * 4/2004 Beedy ..... A63B 21/06 482/93
2004/0092369 A1 * 5/2004 Slawinski ..... A63B 21/00181 482/104
2004/0192519 A1 * 9/2004 Slawinski ..... A63B 21/00181 482/99
2007/0032355 A1 * 2/2007 DiGiacomo ..... A63B 21/4003 482/121
2007/0155598 A1 * 7/2007 Warren ..... A63B 21/075 482/105
2007/0161469 A1 * 7/2007 Lamle ..... A63B 21/00181 482/94
2007/0161473 A1 * 7/2007 McBride ..... A63B 21/065 482/105
2007/0287609 A1 * 12/2007 McBride ..... A63B 21/4009 482/105
2008/0096737 A1 * 4/2008 Ayoub ..... A63B 21/0724 482/107
2008/0287271 A1 * 11/2008 Jones ..... A63B 21/0728 482/107
2009/0325769 A1 * 12/2009 Miskel ..... A63B 21/075 482/107
2010/0323854 A1 * 12/2010 Brandenburg ..... A63B 21/0724 482/106
2012/0202662 A1 * 8/2012 DeMarco ..... A63B 1/00 482/143
2012/0244999 A1 * 9/2012 Tauriainen ..... A63B 21/078 482/104
2013/0288861 A1 * 10/2013 Cole ..... A63B 21/0618 482/102
2014/0073493 A1 * 3/2014 Parish ..... A63B 21/0724 482/104
2014/0256519 A1 * 9/2014 Nelson ..... A63B 21/065 482/105
2014/0274593 A1 * 9/2014 Kelly ..... A63B 21/0004 482/105
2014/0274613 A1 * 9/2014 DeMarco ..... A63B 21/068 482/139

OTHER PUBLICATIONS

Criticalbench Chaos, Sep. 16, 2008, YouTube video: https://youtu.be/hoJytznkI80 “Criticalbench Chaos” by Criticalbench.*

* cited by examiner

SYN RINGS FOR DYNAMIC WEIGHT SUSPENSION

BACKGROUND OF THE INVENTION

Field of the Invention

The present invention relates to exercise apparatus. More specifically, the present invention relates to systems and techniques for exercising using weights supported on a bar.

Description of the Related Art

In the fitness industry, a plethora of machines and devices have been used to facilitate muscular development, body health and overall fitness. One arrangement calls for the suspension of bar bell weights below the bar with rubber bands. This arrangement challenges the user to stabilize the bar against the forces exerted by the dangling weights and results in creates a far more unstable environment, under demanding physical circumstances, than with classic weight training apparatus and movements.

Although the intensity of demand varies depending on the user and situation, the dangling weights require a greater engagement of muscle fibers in the primary agonist muscles as well as the secondary, or stabilizing, muscles in order to maintain stabilization. Numerous peer reviewed and published research papers suggest that resistance training in an unstable environment can create optimal core strength, shoulder strength, and leg strength while increasing neuromuscular control amongst other benefits. "Instability resistance exercises induce high muscle activation of postural limb and trunk muscles. The increased activation has been attributed to the increased stabilization functions. The increased stress associated with instability training has been postulated to promote greater neuromuscular adaptations such as decreased co-contractions of antagonists, improved co-ordination and confidence in performing a skill" David Behm, PhD, CSEP CEP (March 2009). Instability Resistance Training. Canadian Society for Exercise Physiology http://www.csep.ca/english/view.asp?x=724&id=100.

Core stability may provide several benefits to the musculoskeletal system, from maintaining low back health to preventing knee ligament injury. As a result, the acquisition and maintenance of core stability is of great interest to physical therapists, athletic trainers, and musculoskeletal researchers. Core stability is the ability of the lumbopelvic hip complex to prevent buckling and to return to equilibrium after perturbation. Although static elements (bone and soft tissue) contribute to some degree, core stability is predominantly maintained by the dynamic function of muscular elements. There is a clear relationship between trunk muscle activity and lower extremity movement. Current evidence suggests that decreased core stability may predispose to injury and that appropriate training may reduce injury. Core stability can be tested using isometric, isokinetic, and isoinertial methods. Appropriate intervention may result in decreased rates of back and lower extremity injury. John D. Willson, MSPT, Christopher P. Dougherty, DO, Mary Lloyd Ireland, MD and Irene McClay Davis, PhD, PT (September 2005). Core Stability and Its Relationship to Lower Extremity Function and Injury. J Am Acad Orthop Surg, vol. 13 no. 5 316-325 http://www.jaaos.org/content/13/5/316.abstract (Abstract)

Unfortunately, the use of rubber bands to suspend the weights is problematic inasmuch as the bands are difficult to secure at the desired length and are not durable. Moreover, the rubber bands do not effect suspension with any degree of control over the amount of sway or movement experienced by the suspended weights while in use.

Hence, a need remains in the art for an improved arrangement or apparatus for suspending weights for use in a weight lifting exercise.

SUMMARY OF THE INVENTION

The need in the art is addressed by the suspension apparatus of the present invention. In the illustrative embodiment, the invention includes first and second rings, each ring having an inner periphery with an inner radius greater than the outer radius of a standard barbell bar; a coupler secured to the outer periphery of each ring; a strap; and first and second fasteners secured to opposite ends of the strap, whereby the strap may be inserted through an opening in a barbell weight and secured to the rings such that when the rings are mounted on the bar, the weight is free to swing about a point between the rings on the bar over an angle.

In the best mode, the rings are metallic, the strap is nylon and the coupler is a D-ring is attached to a plastic or elastic ring secured to the outer periphery of a respective one of the rings. In an alternative embodiment, a single ring is used to suspend the weight on each end of the bar.

The present disclosure provides a method for suspending a weight below a bar including the steps of securing first and second metallic rings on a metallic bar, each ring having an inner periphery with an inner radius greater than the outer radius of the bar; inserting a strap through an opening in a barbell weight; and attaching a first fastener on a first end of the strap to a coupler secured to the outer periphery of the first ring and a second fastener on a second end of the strap to a coupler secured to the outer periphery of the second ring, whereby the weight is free to swing about a point between the rings on the bar over an angle.

An alternative method for suspending a weight below a bar including the steps of: securing a metallic ring on a metallic bar, each ring having an inner periphery with an inner radius greater than the outer radius of the bar; inserting a strap through an opening in a barbell weight; and attaching a first fastener on a first end of the strap to a D-ring secured to the outer periphery of the first ring and a second fastener on a second end of the strap to a D-ring secured to the outer periphery of the second ring; whereby the weight is free to swing about a point between the rings on the bar over an angle.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
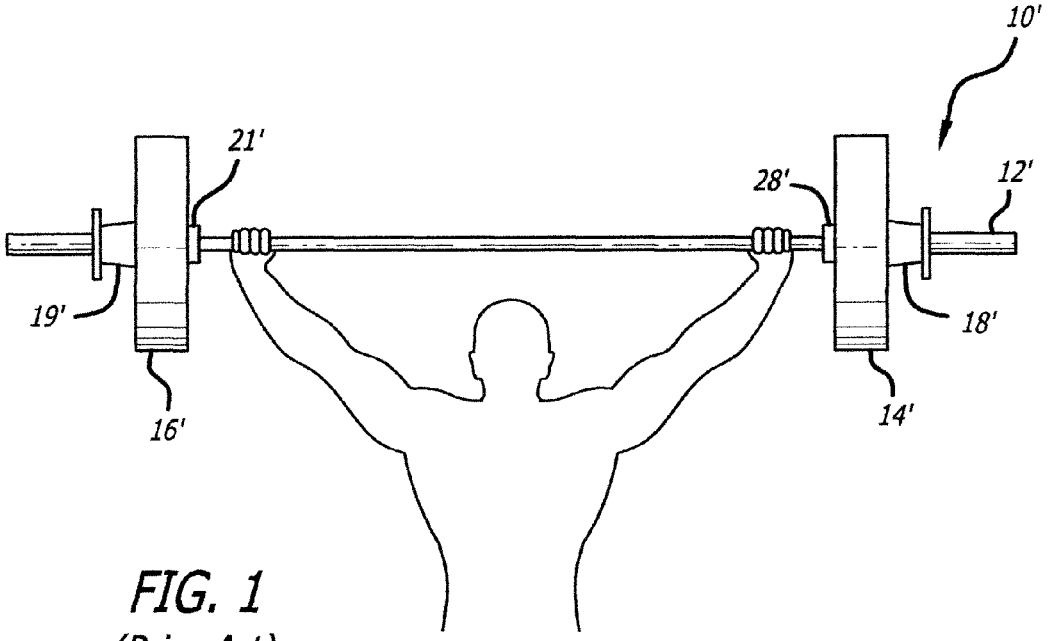
FIG. 1 (Prior Art)
FIG. 1 is a simplified diagram showing a barbell in accordance with conventional teachings and usage.

FIG. 1 is a simplified diagram showing a barbell in accordance with conventional teachings and usage. The arrangement 10' includes a conventional (e.g. standard Olympic weightlifting) bar 12' onto which first and second weights 14' and 16' are mounted. First and second collars 18' and 19' are often used, along with first and second flanges 21' and 23', to secure the weights against translation along the longitudinal axis of the bar 12'.

Figure 2:
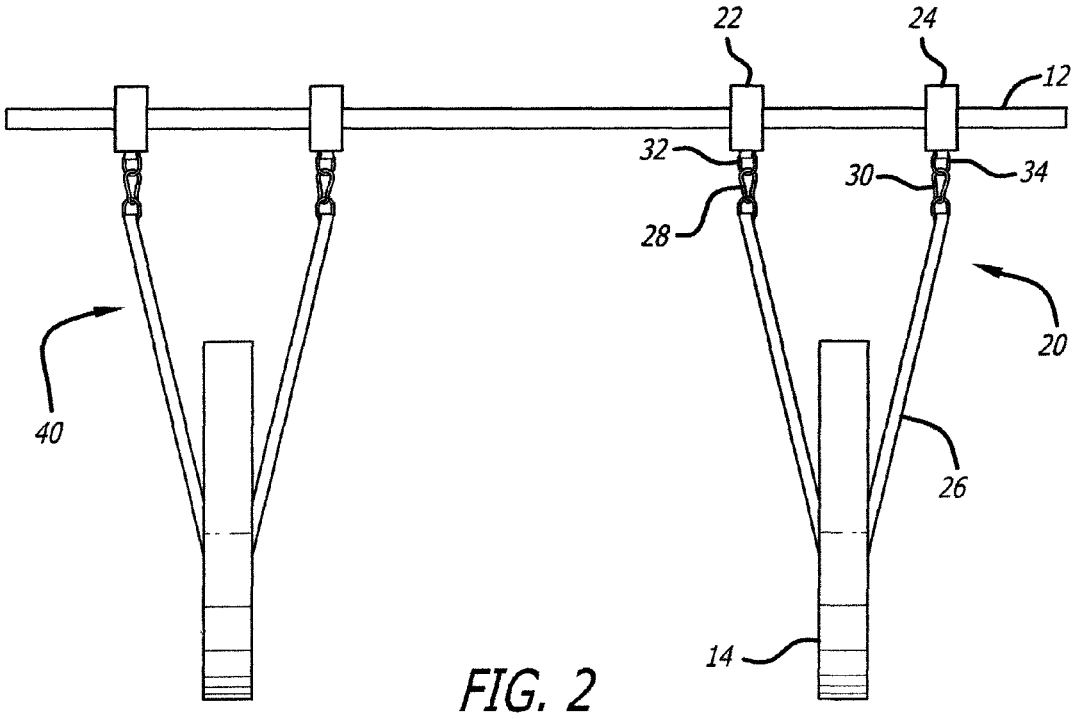
FIG. 2 is a simplified diagram showing first and second suspension apparatus implemented in accordance with the present teachings on a conventional bar.

FIG. 2 is a simplified diagram showing first and second suspension apparatus 10 implemented in accordance with the present teachings on the conventional bar. Each apparatus 20 and 40 includes first and second rings 22 and 24 mounted on the bar 12. Each ring 22, 24 has an inner periphery with an inner radius greater than the outer radius of the standard barbell bar 12. A D-ring 32, 34 is secured to the outer periphery of each ring via a plastic ring. A nylon strap 26 is terminated on each end with and first and second fasteners 28 and 30. The strap 26 is inserted through an opening in a barbell weight 14 and secured to the rings 22 and 24 via the fasteners 28 and 30 and the D-rings 32 and 34, respectively, such that when the rings 22 and 24 are mounted on the bar 12, the weight 14 is free to swing about a point between the rings on the bar over an angle $\alpha$ or $\beta$ as shown in FIGS. 3 and 4.

Figure 3:
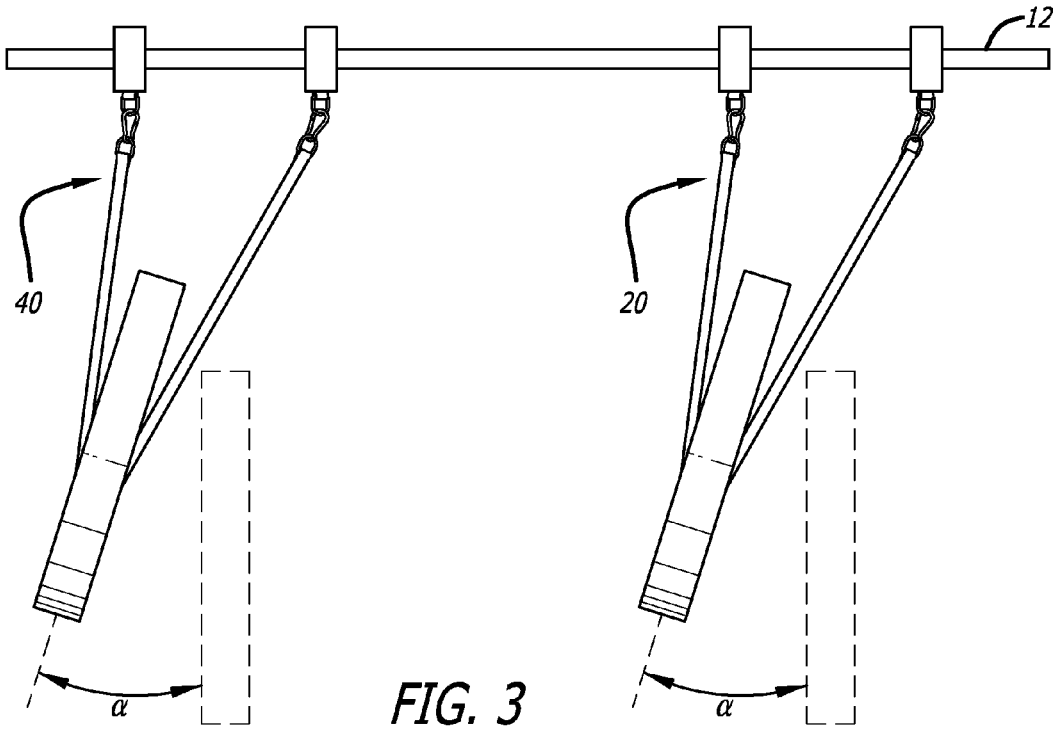
FIG. 3 is a diagram showing the movement of first and second weights suspended by the first and second suspension apparatus of FIG. 2 in a first dynamic position.

FIG. 3 is a diagram showing the movement of first and second weights suspended by the first and second suspension apparatus of FIG. 2 in a first dynamic position.

Figure 4:
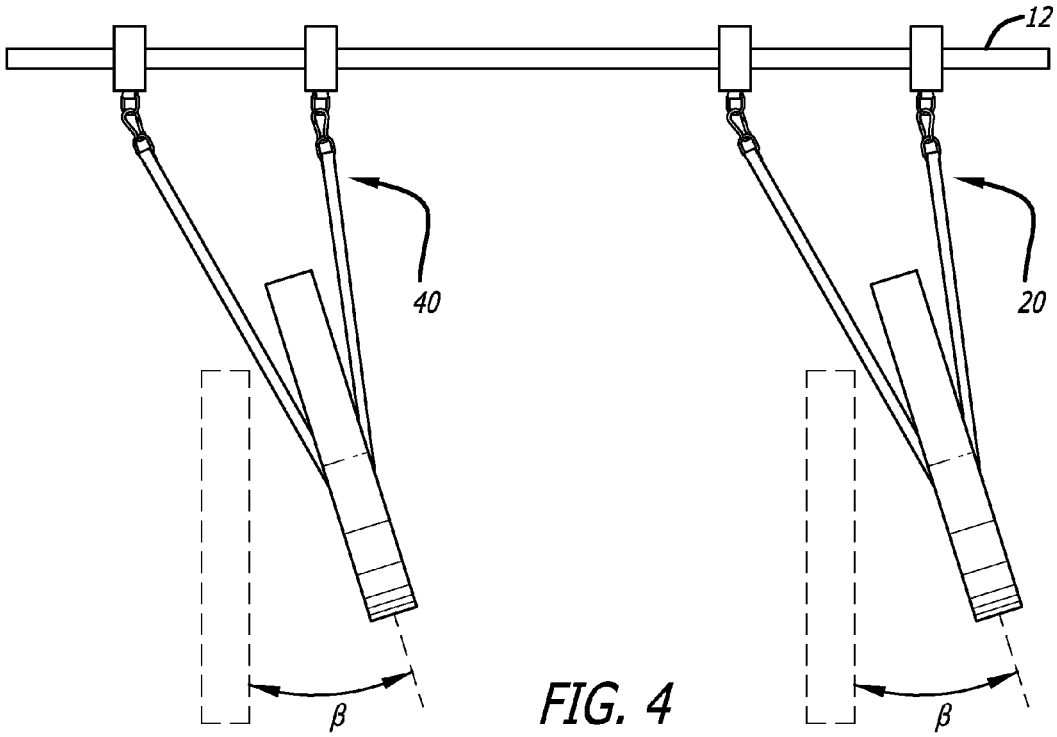
FIG. 4 is a diagram showing the movement of first and second weights suspended by the first and second suspension apparatus of FIG. 2 in a second dynamic position.

FIG. 4 is a diagram showing the movement of first and second weights suspended by the first and second suspension apparatus of FIG. 2 in a second dynamic position.

Figure 5:
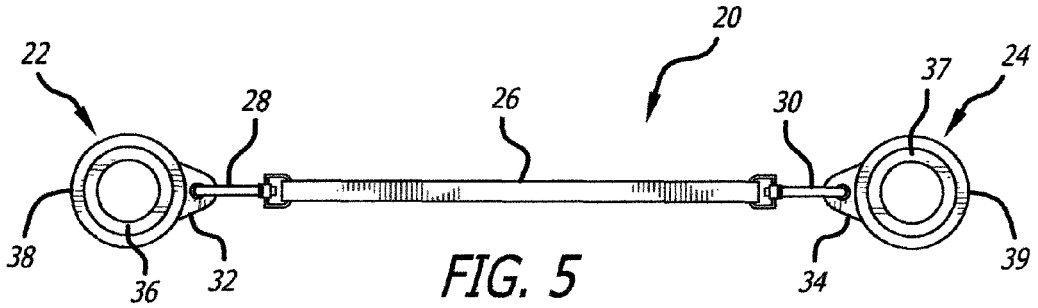
FIG. 5 is an elevated view of the suspension apparatus of the present invention.
Figure 6:
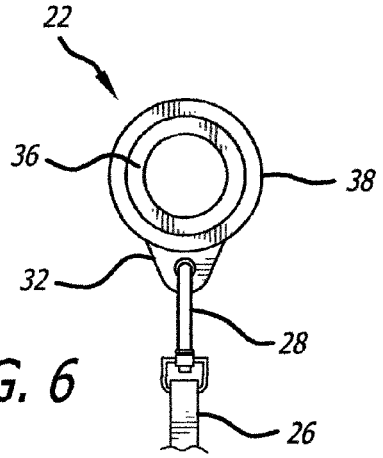
FIG. 6 is a magnified end view of the suspension apparatus of FIG. 5.

FIG. 5 is an elevated view of the suspension apparatus of the present invention. FIG. 6 is a magnified end view of the suspension apparatus of FIG. 5. As shown in FIGS. 5 and 6, the apparatus 20, 40 includes first and second ring assemblies 22 and 24 including inner rings 36 and 37 and outer rings 38 and 39. In the best mode, the inner rings 36 and 37 are aluminum, or other suitably strong material, while the outer rings may be implemented with plastic, rubber or other material. In an alternative embodiment, a second inner ring (not shown) may be included to prevent slippage of the ring on the bar. This optional second inner ring would be rubber or other suitable material.

D-rings 32 and 34 are coupled to the inner rings 36 and 37 via the plastic outer rings 38 and 39 respectively. Removable fasteners 28 and 30 secure the strap 26 to the ring assemblies 22 and 24.

In the illustrative embodiment, the inner ring is approximately 2 inches in diameter. The plastic outer ring is slightly oval shaped with outside diameter $3^{1/16}$ inches across and $3^{3/16}$ inches tall and an inside diameter $2^{7/16}$ across and $2^{1/2}$ tall. In the illustrative embodiment, the strap 26 is approximately 21 inches in length. However the invention is not limited to the dimensions disclosed herein.

Figure 7:
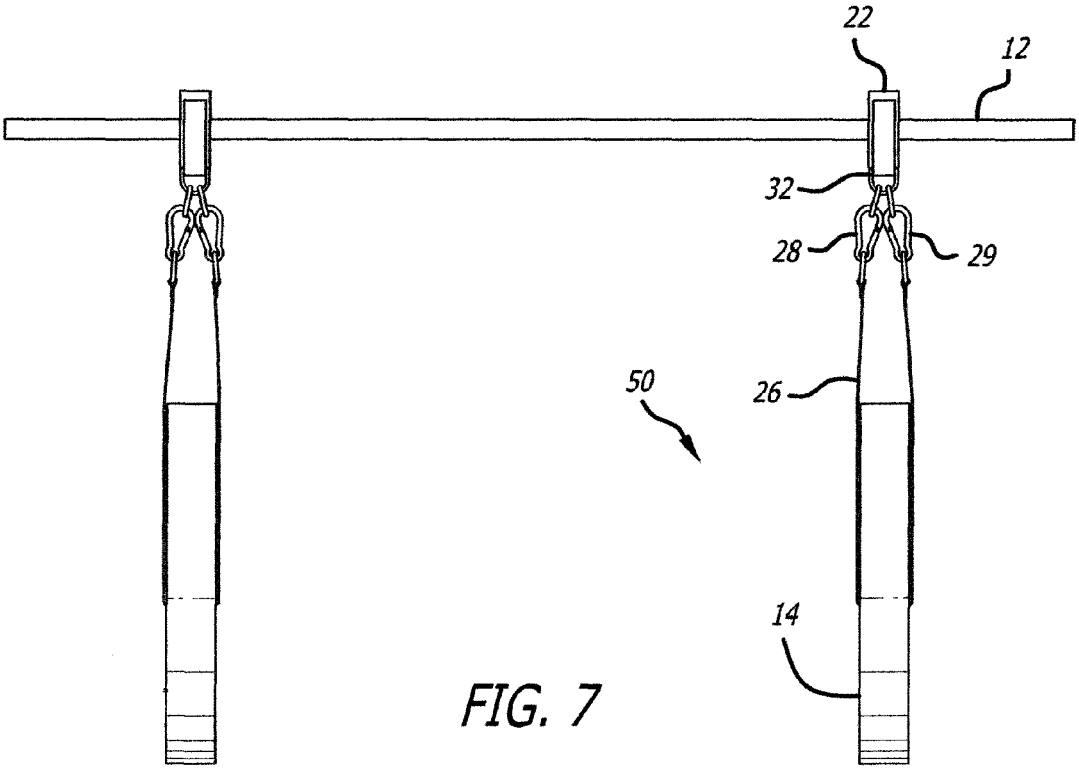
FIG. 7 depicts an alternative embodiment in which the suspension apparatus is implemented with a single ring.

FIG. 7 depicts an alternative embodiment in which the suspension apparatus is implemented with a single ring. The design is otherwise implemented as per the embodiment of FIG. 2 or other suitable implementation in accordance with the present teachings.

Figure 8:
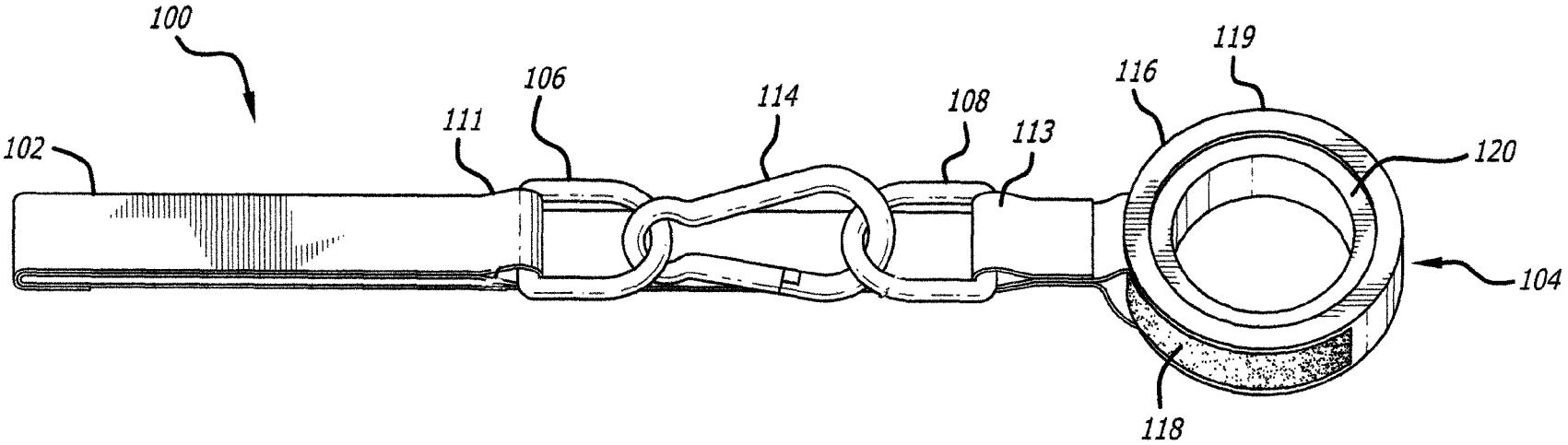
FIG. 8 is an alternative single ring implementation of the inventive suspension apparatus of the present invention.
Figure 9:
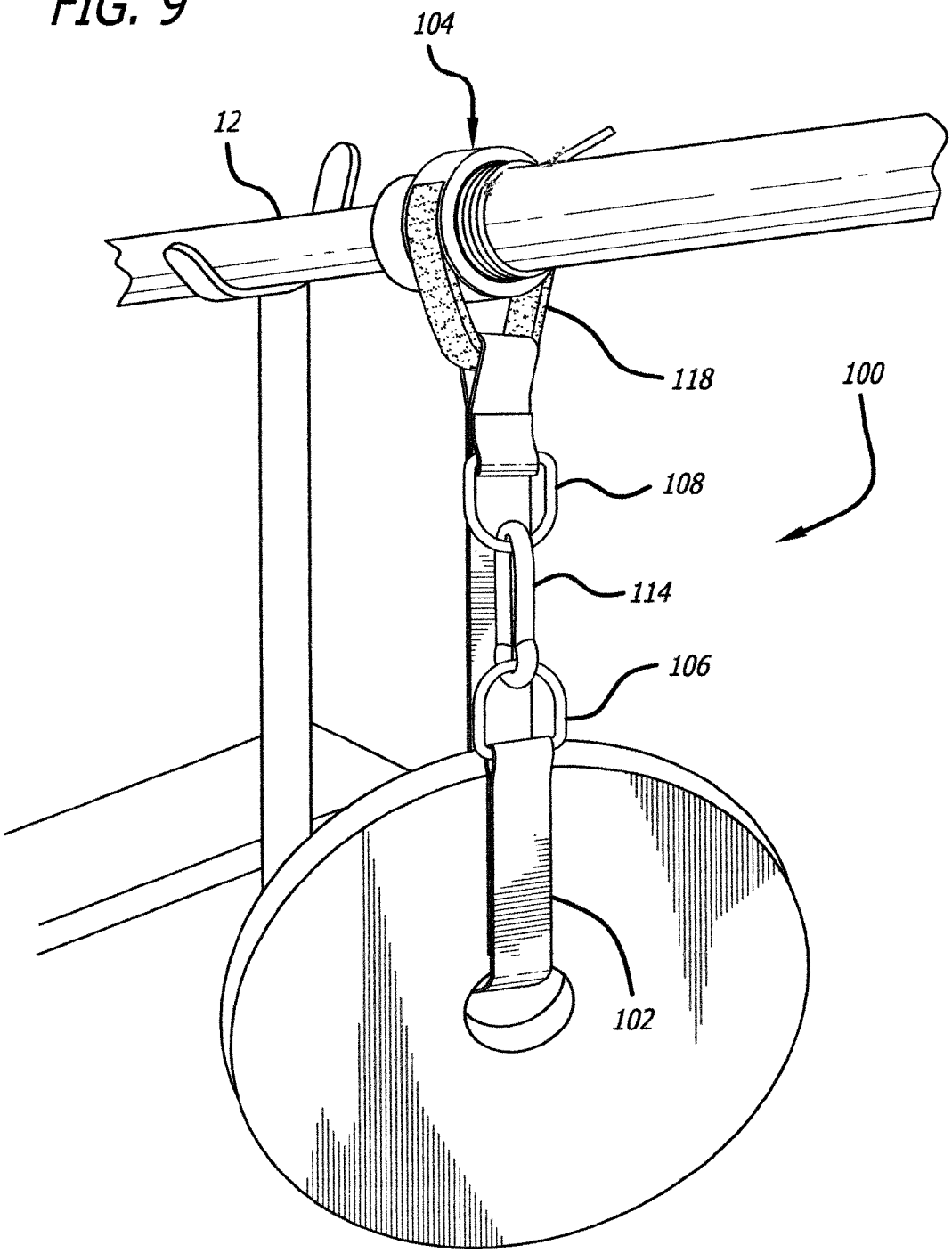
FIG. 9 shows the single ring embodiment of FIG. 8 in use in an illustrative application in accordance with the inventive method.

FIG. 8 is an alternative single ring implementation of the inventive suspension apparatus of the present invention. As shown, the suspension apparatus 100 of FIG. 8 includes a strap 102 and a single ring 104, as per the embodiment of FIG. 7. However, the apparatus 100 is distinctive in that first and second D rings 106 and 108 are secured in loops 111 and 113, respectively, stitched into first and second respective distal ends of the strap 102. In use, the first end of the strap extends through the weight to be suspended as shown in FIG. 9 below. The second end of the strap extends through a rubber band 118 around an aluminum inner ring 120 of the ring 104. The rubber band 118 is secured to the inner ring 120 by two screws 119 (not shown). A plastic outer ring 116 is mounted on the aluminum inner ring 120 between the inner ring 120 and the rubber band 118. As an alternative, the plastic ring may be implemented in two parts mounted at the outer edges of the aluminum ring 120. The D rings 106 and 108 at the opposite ends of the strap 102 are connected by a carabiner 114.

FIG. 9 shows the single ring embodiment of FIG. 8 in use in an illustrative application in accordance with the inventive method.

The inventive apparatus provides the advantages of elastic (aka rubber) band with greater ease of use while it easily attaches to the bar and is lightweight, compact and portable. The invention increases overall strength through a full range of motion, in a variety of lifts, by promoting explosive muscle engagement, forcing the user to engage more muscles, large and small, including areas of the core.

Thus, the present invention has been described herein with reference to a particular embodiment for a particular application. Those having ordinary skill in the art and access to the present teachings will recognize additional modifications, applications and embodiments within the scope thereof. For example, the present invention is not limited to the arrangement by which the strap is secured to the rings, the dimensions or the materials used in the fabrication of the apparatus or the applications thereof. Other arrangements, dimensions, materials and/or applications may be used without departing from the scope of the present teachings.

It is therefore intended by the appended claims to cover any and all such applications, modifications and embodiments within the scope of the present invention.

Accordingly,

What is claimed is:

1. A suspension apparatus for use in combination with a standard barbell bar and a barbell weight comprising:

first and second rings, each ring having an inner periphery with an inner radius greater than an outer radius of the standard barbell bar;

a coupler secured to outer periphery of each ring, the coupler being attached to a plastic ring secured to outer periphery of a respective one of the rings;

a strap; and first and second fasteners secured to opposite ends of the strap whereby the strap is configured to be inserted through an opening in the barbell weight and secured to the rings such that when the rings are mounted on the bar, the weight is free to swing about a point between the rings on the bar over an angle.

2. The invention of claim 1 wherein the rings are metallic.

3. The invention of claim 1 wherein the strap is nylon.

4. A suspension apparatus comprising:

at least one first ring;

a second ring secured to an outer periphery of each first ring, the second ring being elastic;

a coupler secured to the elastic ring;

a strap; and first and second fasteners secured to opposite ends of the strap, whereby the strap is configured to be inserted through an opening in a barbell weight and secured to the coupler such that when the first ring is mounted on a bar, the weight is free to swing over an angle and up and down on the elastic ring.

5. The invention of claim 4 wherein the first ring is metallic.

6. The invention of claim 4 wherein the strap is nylon.

7. A method for suspending a weight below a bar including the steps of:

securing first and second rings on a bar, each ring having an inner periphery with an inner radius greater than an outer radius of the bar;

inserting a strap through an opening in a barbell weight; and attaching a first fastener on a first end of the strap to a coupler secured to an outer periphery of the first ring and a second fastener on a second end of the strap to a coupler secured to the outer periphery of the second ring;

whereby the weight is free to swing about a point between the rings on the bar over an angle.

8. A method for suspending a weight below a bar including the steps of:

securing at least one first ring on a bar, each ring having an inner periphery with an inner radius greater than an outer radius of the bar;

inserting a strap through an opening in a barbell weight; and inserting a first fastener on a first end of the strap through a band around an outer periphery of the first ring and attaching the first fastener to a second fastener on a second end of the strap;

whereby the weight is free to swing on the bar over an angle.

* * * * *